US008056497B1

(12) United States Patent
Rondeau et al.

(10) Patent No.: US 8,056,497 B1
(45) Date of Patent: Nov. 15, 2011

(54) BOAT COVERING SYSTEM

(75) Inventors: Pierre Rondeau, St-Denis-de-Brompton (CA); Claude Gagnon, Magog (CA); Sam Spade, Palm Bay, FL (US); Joey Larouche, Mont-Saint-Hilaire (CA); Vincent Tognon, Drummondville (CA); Daniel Mercier, Magog (CA)

(73) Assignee: BRP US Inc., Sturtevant, WI (US)

( * ) Notice: Subject to any disclaimer, the term of this patent is extended or adjusted under 35 U.S.C. 154(b) by 323 days.

(21) Appl. No.: 12/363,408

(22) Filed: Jan. 30, 2009

Related U.S. Application Data

(60) Provisional application No. 61/026,648, filed on Feb. 6, 2008.

(51) Int. Cl.
*B63B 17/00* (2006.01)

(52) U.S. Cl. ..... 114/363

(58) Field of Classification Search ..... 114/361
See application file for complete search history.

(56) References Cited

U.S. PATENT DOCUMENTS

| | | | | |
|---|---|---|---|---|
| 3,354,892 | A | 11/1967 | Frieder | |
| 3,475,772 | A | 11/1969 | Lokken | |
| 4,075,723 | A | 2/1978 | Bareis et al. | |
| 4,091,484 | A | 5/1978 | Means | |
| 4,683,900 | A | 8/1987 | Carmichael | |
| 4,768,457 | A | 9/1988 | Jones | |
| 4,926,782 | A | 5/1990 | Lacy | |
| 4,995,329 | A | 2/1991 | Kleine | |
| 5,044,298 | A | 9/1991 | Pepper et al. | |
| 5,228,408 | A * | 7/1993 | Jannausch | 114/361 |
| 5,228,409 | A | 7/1993 | Hodonsky | |
| 5,303,667 | A | 4/1994 | Zirkelbach et al. | |
| 5,396,861 | A | 3/1995 | Acker et al. | |
| 5,640,924 | A * | 6/1997 | Murrant | 114/361 |
| 5,743,208 | A | 4/1998 | Miller | |
| D409,972 | S | 5/1999 | Todd | |
| 6,006,692 | A | 12/1999 | Szukhent, Jr. | |
| 6,158,377 | A | 12/2000 | Szukhent, Jr. | |

(Continued)

FOREIGN PATENT DOCUMENTS

DE 202006009963 U1 8/2006

(Continued)

OTHER PUBLICATIONS

English Abstract of DE202006009963.

*Primary Examiner* — Stephen Avila
(74) *Attorney, Agent, or Firm* — Osler, Hoskin & Harcourt LLP

(57) ABSTRACT

A boat coverable by a flexible cover has a hull, a deck, and a tower movably connected to the deck. The tower has a central structure. The tower is movable between a first position and a second position. The deck is coverable by the flexible cover when the tower is in the second position such that the flexible cover is associated with at least a portion of the central structure. The portion of the central structure is movable to a third position vertically intermediate positions of the central structure in the first and second positions of the tower to tension the cover. A boat having a flexible cover connected to the central structure of the tower and a method of a method of installing a flexible cover on a boat are also disclosed.

23 Claims, 13 Drawing Sheets

U.S. PATENT DOCUMENTS

| | | | |
|---|---|---|---|
| D442,910 | S | 5/2001 | Metcalf |
| 6,260,505 | B1 | 7/2001 | Polidan |
| 6,327,993 | B1 | 12/2001 | Richens, Jr. |
| 6,666,163 | B2 | 12/2003 | Pastor et al. |
| 6,688,252 | B1 | 2/2004 | Caravella |
| 6,789,495 | B2 | 9/2004 | Brower et al. |
| 6,997,131 | B2 | 2/2006 | Jackson et al. |
| 7,013,830 | B1 | 3/2006 | Willis |
| 7,051,669 | B2 | 5/2006 | Warfel et al. |
| 7,093,558 | B1 | 8/2006 | Mandanici |
| 7,270,075 | B1 | 9/2007 | Jones |
| 7,370,599 | B1 | 5/2008 | Berman et al. |
| 7,373,897 | B2 | 5/2008 | Tufte |
| 7,418,918 | B2 | 9/2008 | Bierbower et al. |
| 7,430,980 | B2 | 10/2008 | Fishburn |
| 7,438,015 | B1 * | 10/2008 | Schwindaman ..... 114/361 |
| 2003/0217683 | A1 | 11/2003 | Heckman |
| 2005/0284356 | A1 | 12/2005 | Townsend |
| 2007/0290016 | A1 | 12/2007 | Jesewitz |
| 2008/0141926 | A1 | 6/2008 | Tufte |
| 2008/0202406 | A1 | 8/2008 | Del Valle Bravo et al. |

FOREIGN PATENT DOCUMENTS

| | | | |
|---|---|---|---|
| WO | 02068260 | A1 | 9/2002 |
| WO | 2006072055 | A3 | 7/2006 |

* cited by examiner

BOAT COVERING SYSTEM

CROSS-REFERENCE

The present application claims priority to U.S. Provisional Application No. 61/026,648, filed Feb. 6, 2008, the entirety of which is incorporated herein by reference.

FIELD OF THE INVENTION

The present invention relates to a boat covering system.

BACKGROUND OF THE INVENTION

Many boats, such as sport boats, have at least a portion of the deck which is opened. This means that the opened portions of the deck are not protected from rain by a cabin having a roof for example. For this reason, many boat owners use a flexible cover to cover the opened portions of the deck when their boats are docked or placed in storage to prevent rain water from pooling inside the opened deck portions and to prevent the deck from becoming dirty.

The flexible covers are typically made of canvas that is treated to be impermeable to water. To install the flexible cover, a person installing the cover, while being inside the boat, first connects the flexible cover to one side of the deck. The cover is then extended over the opened portions of the deck, and the person installing the cover, who is now outside the boat, finally connects the flexible cover to the other side of the deck.

Since the cover is flexible, it is likely to sag in some places, which results in rain water pooling in these places on the cover. In order to minimize the size and number of places where water can pool on the flexible cover, removable poles are sometimes used to tension the cover. However, because they are made to tension the flexible cover, these poles make it more difficult to connect the flexible cover to the second side of the deck. The use of such poles also complicates the installation of the cover and may prove cumbersome to some people. Also, these poles may require the addition of hardware on the floor of the deck to hold the poles, and people walking on the deck may hit their feet on this hardware.

Also, some boats are provided with towers. The towers may be used, for example, to provide a top for making shade on the deck, to provide a platform on which a person can stand, or to provide a structure to tow a water skier or wakeboarder. A tower may also provide more than one of these functions. However, these towers complicate the installation of a flexible cover, since the cover needs to go around the legs of the tower in order to properly prevent the entry of rain water on the deck.

Therefore, there is a need for a boat coverable by a flexible cover that reduces the likelihood of rain water from pooling on the flexible cover.

There is also a need for a boat having a tower that can relatively easily be covered by a flexible cover.

SUMMARY OF THE INVENTION

It is an object of the present invention to ameliorate at least some of the inconveniences present in the prior art.

It is also an object of the present invention to provide a boat coverable by a flexible cover having a movable tower with a central structure, where at least a portion of the central structure is used to tension the flexible cover when the flexible cover is used to cover the deck of the boat.

It is another object of the present invention to provide a boat having a movable tower with a central structure and a flexible cover connected to the central structure, where at least a portion of the central structure is used to tension the flexible cover when the flexible cover is used to cover the deck of the boat.

It is yet another object of the present invention to provide a method of installing a flexible cover on a boat having a tower with a central structure which includes using at least a portion of the central structure to tension the flexible cover once the flexible cover covers the deck of the boat.

In one aspect, the invention provides a boat coverable by a flexible cover. The boat has a hull, a deck disposed on the hull, and a tower movably connected to the deck. The tower has a central structure. The tower is movable between a first position and a second position. The central structure is closer to the deck when the tower is in the second position than when the tower is in the first position. The deck is coverable by the flexible cover when the tower is in the second position such that the flexible cover is associated with at least a portion of the central structure. The portion of the central structure is movable to a third position vertically intermediate positions of the central structure in the first and second positions of the tower to tension the cover.

In an additional aspect, the tower is movably connected to the deck via a pivot.

In a further aspect, the complete central structure is movable to the third position to tension the cover.

In an additional aspect, an actuator is operatively connected to the tower to move the tower between the first and second positions.

In a further aspect, an actuator is operatively connected to the portion of the central structure. The actuator is adapted to move the portion of the central structure to the third position while a remainder of the central structure remains in the position of the central structure in the second position of the tower.

In an additional aspect, the central structure is a rigid top.

In a further aspect, the rigid top defines a storage compartment therein adapted to receive the flexible cover when the flexible cover is not covering the deck.

In an additional aspect, at least one canopy is connected to the rigid top.

In a further aspect, the deck is coverable by the flexible cover when the tower is in the second position such that the flexible cover covers at least the portion of the central structure.

In another aspect, the invention provides a boat having a hull, a deck disposed on the hull, and a tower movably connected to the deck. The tower includes a left arm having a first end movably connected to a left side of the deck, a right arm having a first end movably connected to a right side of the deck, and a central structure movably connected to a second end of the left arm and a second end of the right arm. The central structure is at least partially disposed laterally between the left and right arms. A flexible cover is connected to the central structure. The tower is movable between a first position and a second position. The central structure is closer to the deck when the tower is in the second position than when the tower is in the first position. The flexible cover is selectively connectable to at least one of the hull and the deck when the tower is in the second position such that the flexible cover covers at least a portion of the deck. The portion of the central structure is movable to a third position vertically intermediate the positions of the central structure in the first and second positions of the tower to tension the cover.

In an additional aspect, the first end of the left arm is movably connected to the left side of the deck via a pivot. The first end of the right arm is movably connected to the right side of the deck via a pivot. The central structure is movably connected to the second end of the left arm and the second end of the right arm via pivots.

In a further aspect, an actuator is operatively connected to at least one of the left and right arms to move the tower between the first and second positions.

In an additional aspect, the complete central structure is movable to the third position to tension the cover.

In a further aspect, an actuator is operatively connected to the portion of the central structure. The actuator is adapted to move the portion of the central structure to the third position while a remainder of the central structure remains in the position of the central structure in the second position of the tower.

In an additional aspect, the central structure is a rigid top. The rigid top defines a storage compartment therein adapted to receive the flexible cover when the flexible cover is not covering at least the portion of the deck. The flexible cover is connected to the storage compartment.

In a further aspect, the left arm is a first left arm and the right arm is a first right arm. A second left arm has a first end movably connected to the left side of the deck rearwardly of the first left arm. A second right arm has a first end movably connected to the right side of the deck rearwardly of the first right arm. The central structure is movably connected to a second end of the second left arm and a second end of the second right arm. The central structure is at least partially disposed laterally between the second left arm and the second right arm.

In an additional aspect, the flexible cover is selectively connectable to at least one of the hull and the deck when the tower is in the second position such that the flexible cover covers at least a portion of the central frame.

In yet another aspect, the invention provides a method of installing a flexible cover on a boat. The boat has a hull, a deck disposed on the hull, and a tower movably connected to the deck. The tower has a central structure. The method comprises: lowering the central structure; covering at least a portion of the deck with the flexible cover once the central structure is lowered; connecting the flexible cover to at least one of the deck and the hull; and raising at least a portion of the central structure associated with the flexible cover once the flexible cover is connected to tension the cover.

In an additional aspect, lowering the central structure includes pivoting the tower.

In a further aspect, raising at least the portion of the central structure includes raising the complete central structure.

In an additional aspect, the flexible cover includes multiple cover sections and the method further comprises connecting the multiple cover sections to one another.

In a further aspect, the central structure is a rigid top.

In an additional aspect, the method further comprises covering at least a portion of the central structure with the flexible cover once the central structure is lowered, and the portion of the central structure associated with the flexible cover is the portion of the central structure covered with the flexible cover.

For purposes of this application, terms related to spatial orientation such as forwardly, rearwardly, left, and right, are as they would normally be understood by a driver of the boat sitting thereon in a normal driving position. Also for purposes of this application, the term "tower" comprises towers, half-towers, and ski and wakeboard towers.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
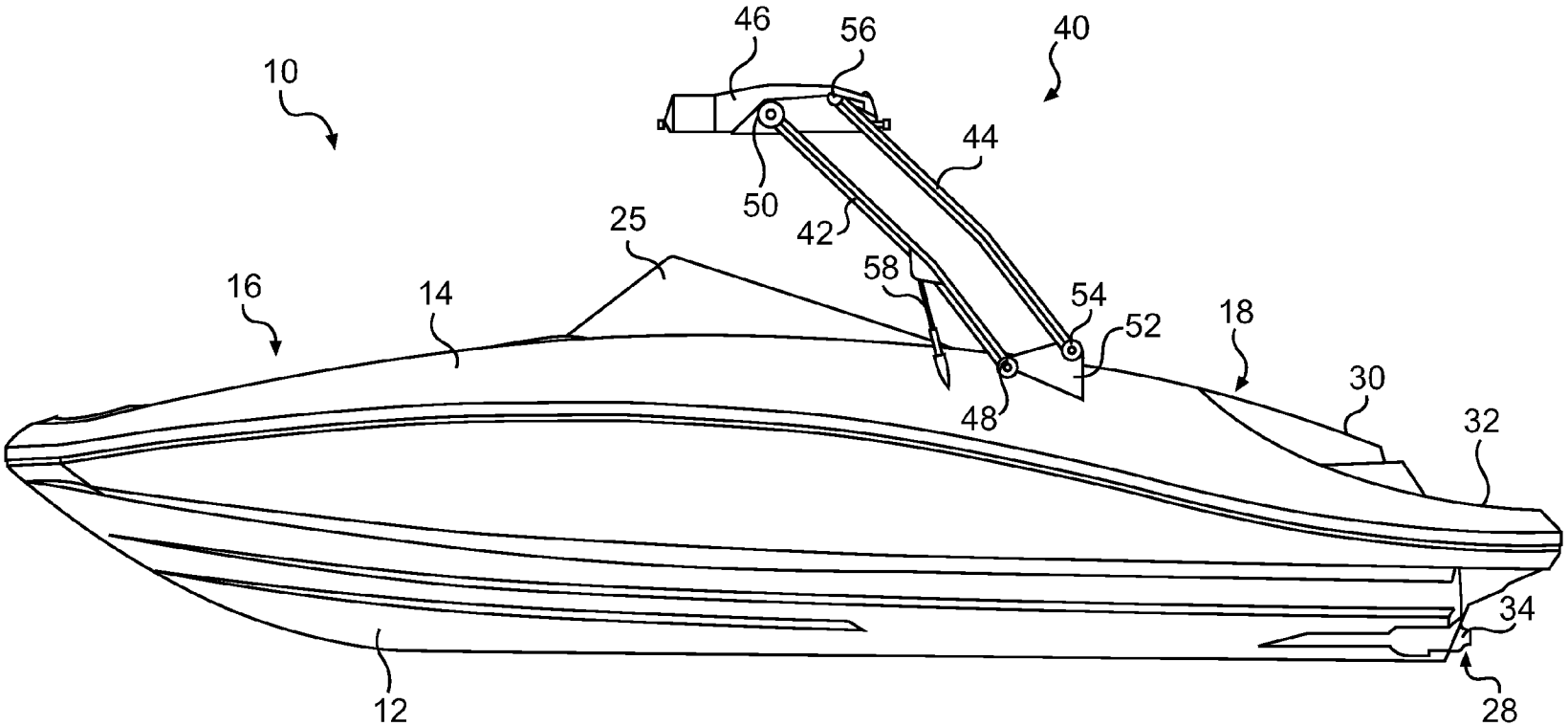
FIG. 1 is a left side elevation view of a boat according to an embodiment of the present invention, with a tower of the boat in a raised position.

The present invention will be described with respect to a sport boat. However, it should be understood that other types of boats are contemplated, such as pontoons or catamarans for example.

The general construction of a sport boat 10 in accordance with this invention will now be described with respect to FIGS. 1 to 3. The following description relates to one way of manufacturing a sport boat. Those of ordinary skill in the art of sport boats should recognize that there are other known ways of manufacturing and designing sport boats and that this invention would encompass these other known ways and designs.

The sport boat 10 has a hull 12 and a deck 14 supported by the hull 12. The deck 14 has a forward passenger area 16 and a rearward passenger area 18. A right console 20 and a left console 22 are disposed on either side of the deck 14 between the two passenger areas 16, 18. A passageway 24 disposed between the two consoles 20, 22 allows for communication between the two passenger areas 16, 18. A windshield 25 is provided at least partially on the right and left consoles 20, 22 to shield the passengers sitting in the rearward passenger area 18 from the wind when the boat 10 is in movement. The right console 20 accommodates all of the elements necessary to the driver to operate the boat 10. These include, but are not limited to: a steering assembly including a steering wheel 26, a throttle lever, and an instrument panel. The instrument panel has various dials indicating the boat speed, engine speed, fuel and oil level, and engine temperature.

At least one engine (not shown) is located between the hull 12 and the deck 14 at the back of the boat 10. The engine powers the jet propulsion system 28 of the boat 10 described in greater detail below. It is contemplated that the boat 10 could alternatively be propelled by a stern drive or an outboard engine. The engine is accessible through an engine cover 30 located behind the rearward passenger area 18. The engine cover 30 can also be used as a sundeck for a passenger of the boat 10 to sunbathe on while the boat 10 is not in motion. A reboarding platform 32 is located at the back of the deck 14 for passengers to easily reboard the boat 10 from the water.

The jet propulsion system 28 pressurizes water to create thrust. The water is first scooped from under the hull 12 through an inlet (not shown), which preferably has a grate (not shown). The inlet grate prevents large rocks, weeds, and other debris from entering the jet propulsion system 28, which may damage the system or negatively affect performance Water flows from the inlet 28 through a water intake ramp (not shown). From the intake ramp, water enters a jet pump (not shown). Once the water leaves the jet pump, it goes through a venturi (not shown) that is connected to the rearward end of the jet pump. A steering nozzle 34 is rotationally mounted relative to the venturi to redirect the jet of water from the venturi and, as a result, steer the boat 10. The steering nozzle 34 is operatively connected to the steering wheel 26 via a push-pull cable (not shown) such that when the steering wheel 26 is turned, the steering nozzle 34 pivots. It is contemplated that the steering nozzle 34 could alternatively be connected to the steering wheel 26 via an electronic drive-by-wire system.

The jet propulsion system 28 is provided with a reverse gate (not shown) which can be used to redirect the jet of water being expelled by the steering nozzle 34 towards a front of the boat 10 and, as a result, cause the boat 10 to move in a reverse direction.

The boat 10 has a tower 40 movably connected to the deck 14. The tower 40 includes left and right front arms 42, left and right rear arms 44 disposed rearwardly of the front arms 42, and a central structure in the form of a rigid top 46 disposed between the upper ends of the arms 42, 44. Each of the arms 42, 44 is made of two sections connected to each other at an angle to form a bend near the center of each of the arms 42, 44. However it is contemplated that each of the arms 42, 44 could be made of a single straight section or of more than two sections. The rigid top 46 provides a shaded area on the deck 14. It is contemplated that the central structure could alternatively be a platform on which a person could stand or a tubular structure to provide an attachment point to tow a water skier or a wakeboarder, for example, behind the boat 10 or other central structures known to be provided on a tower of a boat. It is also contemplated that the central structure could combine the functions of more than one of the previously mentioned structures. For example, the rigid top 46 could be provided with an attachment point to tow a water skier or a wakeboarder.

Figure 3:
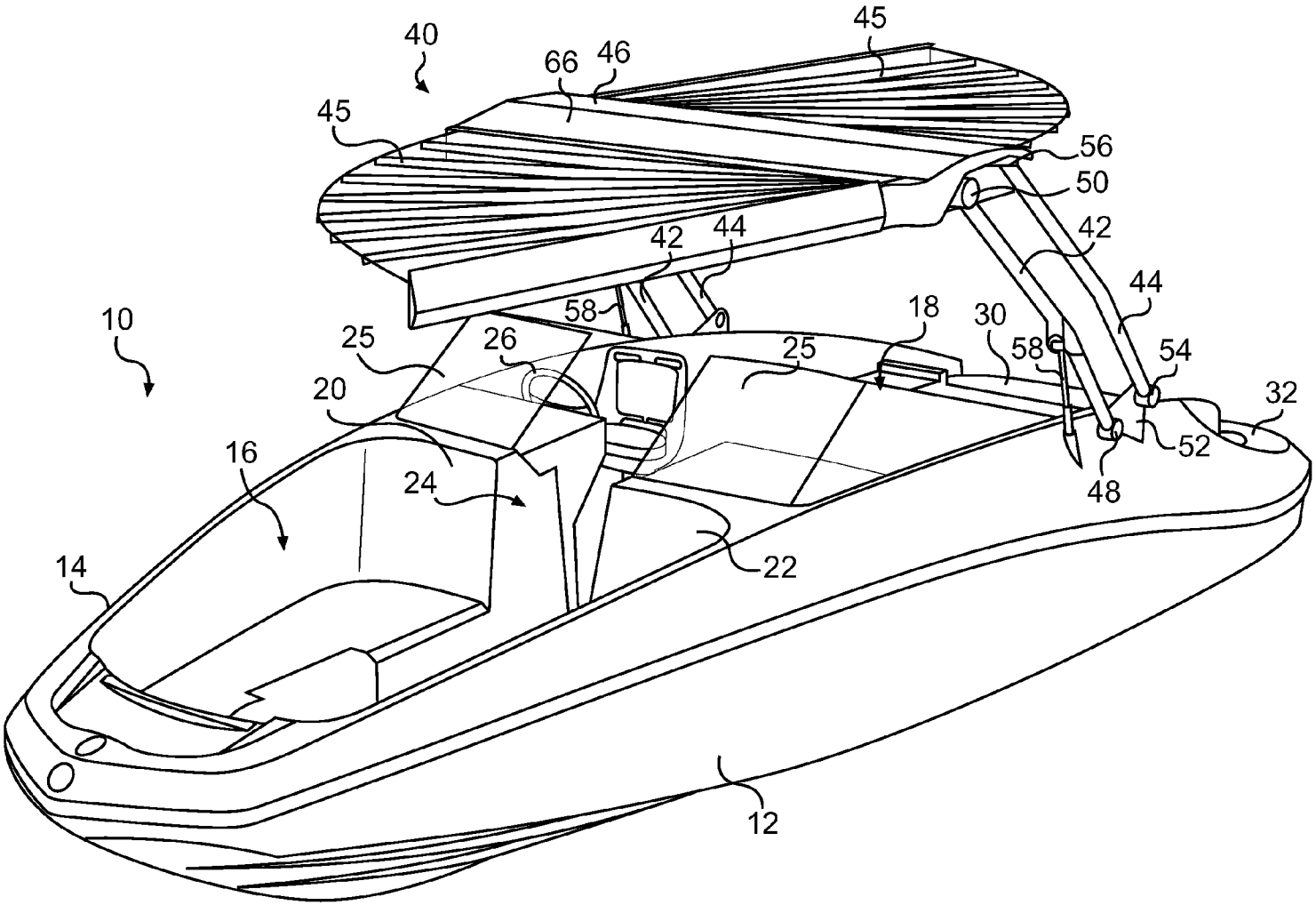
FIG. 3 is a perspective view, taken from a front, left side, of the boat of FIG. 1, with canopies in their extended positions.

As can be seen in FIG. 3, two retractable canopies 45 are connected to either side (front and back) of the rigid top 46. The canopies 45 are fan-type canopies that can be extended as shown to provide increased shading on the deck 14. When they are not in use, the canopies 45 are retracted inside storage compartments 47 (FIG. 4) formed in the rigid top 46. It is contemplated that only one canopy 45, more than two canopies 45, or no canopy 45 could be provided. It is contemplated that other types of canopies 45, such as bimini tops, could alternatively be provided.

Figure 5:
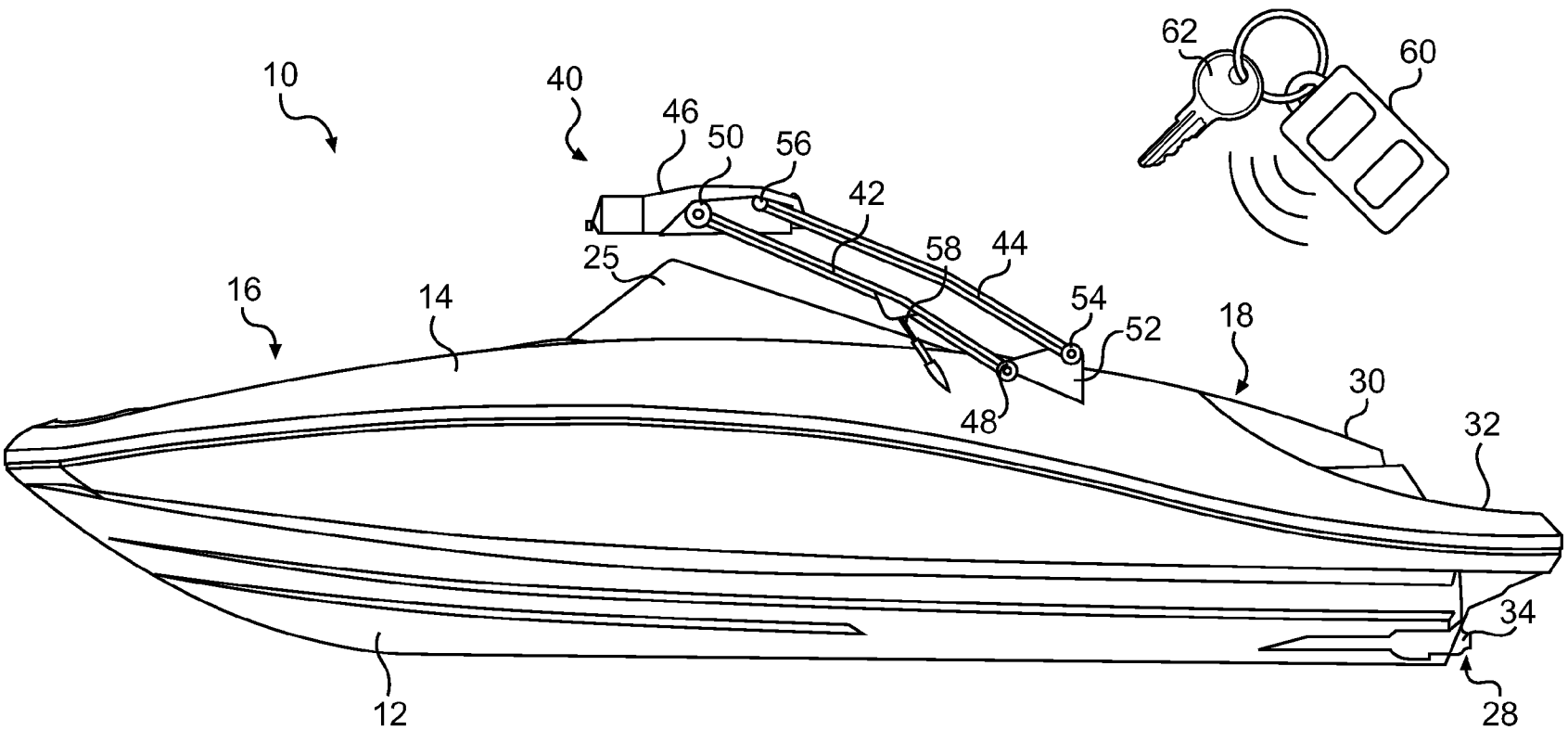
FIG. 5 is a left side elevation view of the boat of FIG. 1, with the tower in a lowered position.
Figure 6:
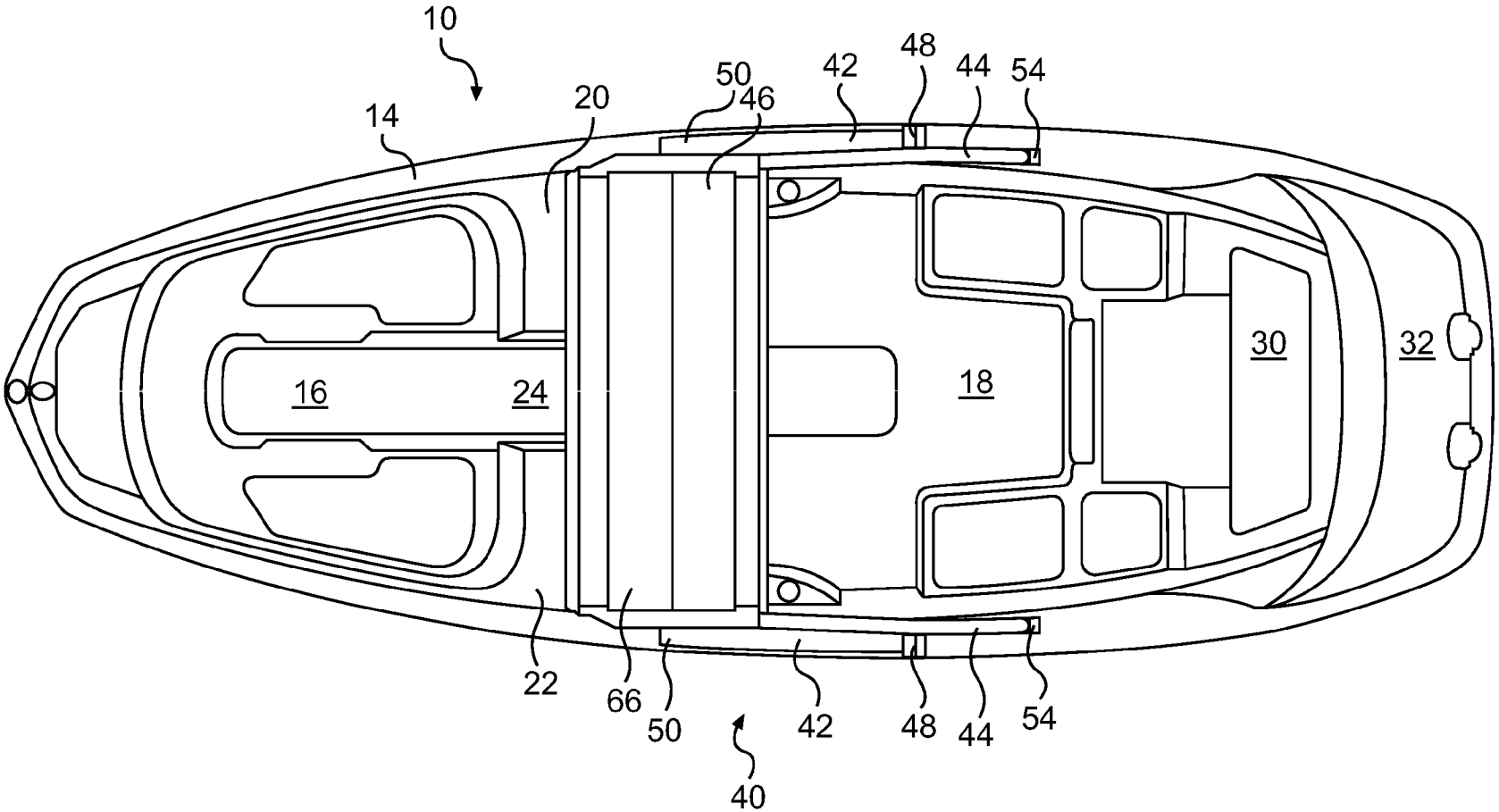
FIG. 6 is a top plan view of the boat of FIG. 1, with the tower in a lowered position.

The lower end of each front arm 42 is connected to the deck 14 via a pivot 48. The upper end of each front arm 42 is connected to the rigid top 46 via a pivot 50 recessed in the side of the rigid top 46. The lower end of each rear arm 44 is connected to a bracket 52 via a pivot 54 disposed rearwardly and upwardly of the pivot 48. The bracket 52 is mounted to the deck 14. The upper end of each rear arm 44 is connected to the rigid top 46 via a pivot 56 recessed in the side of the rigid top 46. The pivot 56 is disposed rearwardly and upwardly from the pivot 50. As can be seen, each of the arms 42, 44 has a bend in it. As the arms 42, 44 pivot about the pivots 48, 54, the rigid top 46 moves in an arc and pivots about the pivots 50, 56 so as to maintain a generally horizontal orientation regardless of the position of the arms 42, 44. By pivoting the arms 42, 44, the area to which the rigid top 46 provides shading can be changed, and the rigid top 46 can also be moved to a lowered position shown in FIGS. 5 to 7, the reason for which will be described in greater detail below.

Left and right linear actuators 58 are provided to pivot the tower 40. Each linear actuator 58 has one end connected to a corresponding one of the left and right front arms 42 and another end connected to the deck 14. The linear actuators 58 preferably each consist of a worm gear connected to a rotary electric motor and a rod associated with the worm gear that translates in response to the rotation of the worm gear. Alternatively, the linear actuators 58 could be hydraulic or pneumatic cylinders. It is contemplated that the linear actuators 58 could be connected to the rear arms 44 instead of the front arms 42. It is also contemplated that the linear actuators 58 could be replaced with one or more rotary actuators operatively connected to one or more of the pivots 48, 54. It is contemplated that only one or more than two linear actuators 58 could be provided. Finally, it is also contemplated that no actuators could be provided and the tower 40 could be pivoted manually. In such a case, a mechanism would be provided to allow the tower 40 to be locked into position.

A remote control 60 (FIG. 5) is provided which can be used by a user of the boat 10 to wirelessly control the linear actuators 58, and therefore the position of the tower 40. As can be seen, the remote control 60 is incorporated into a key chain used to hold the key 62 of the boat 10. Alternatively, switches or levers provided on the deck 14, such as on one of the consoles 20, 22, could be used to control the linear actuators 58.

Figure 4:
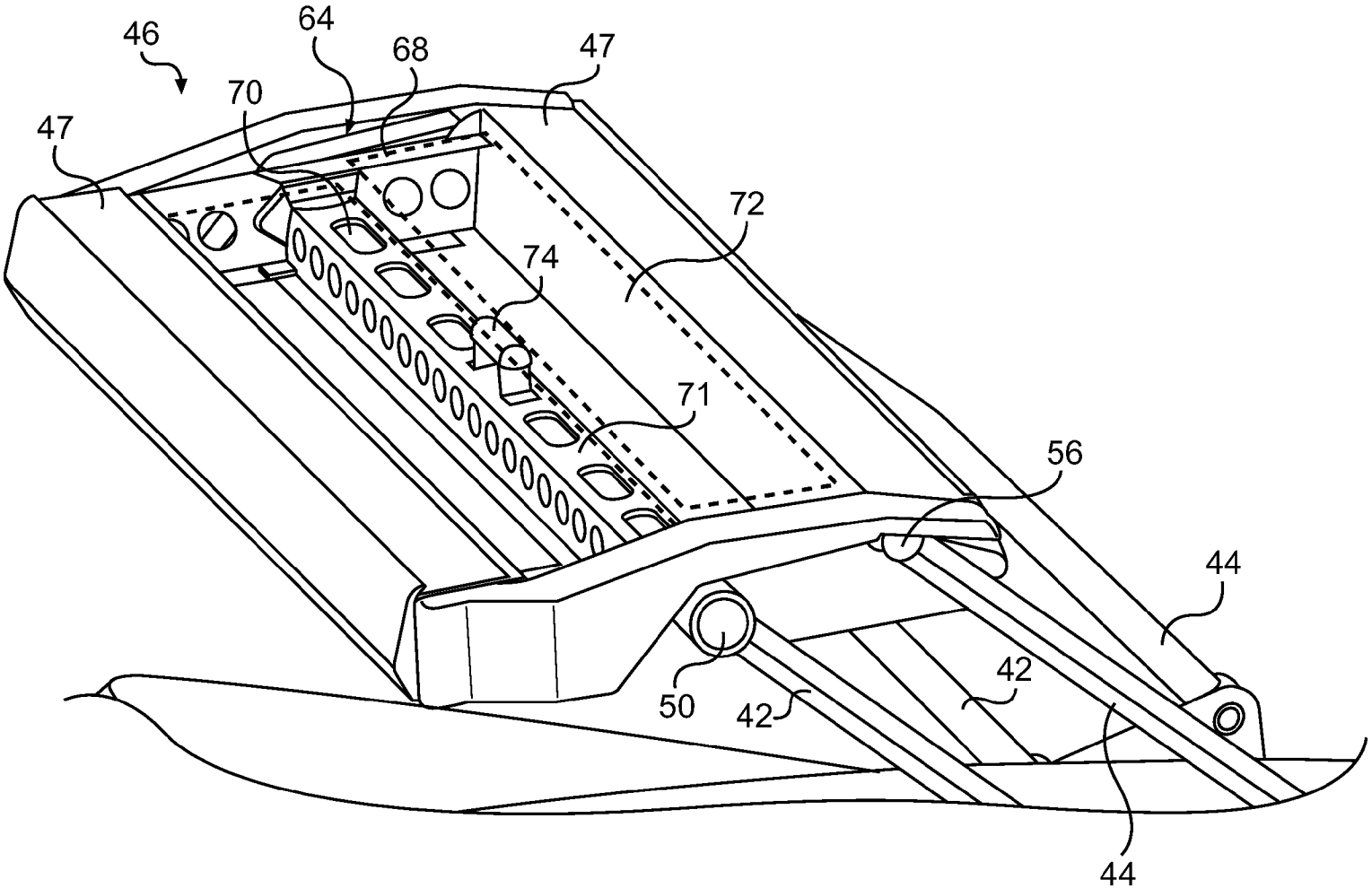
FIG. 4 is a perspective view, taken from a front, left side, of a top of the tower of the boat of FIG. 1, with a lid of the top removed.

Turning now to FIG. 4, the rigid top 46 of the tower 40 will be described in more detail. The rigid top 46 is preferably made of rigid plastic or similar material, such as fiberglass. As previously discussed, the rigid top 46 has front and rear storage compartments 47 to receive the canopies 45. The rigid top 46 also defines a central storage compartment 64 disposed between the storage compartments 47. A removable lid 66 (removed in FIG. 4, but shown in FIG. 3) is used to close the storage compartment 64. A metallic frame 68 is provided inside the storage compartment 64 to increase the rigidity of the rigid top 46. A torsion bar 70 disposed inside a portion 71 of the metallic frame 68 connects the two pivots 50.

A folded flexible cover 72 (shown in phantom) is stored inside the storage compartment 64. The flexible cover 72 is used to cover the deck 14 of the boat 10 when the boat 10 is not in use as described below. The flexible cover 72 is preferably made of canvas that is treated to be impermeable to water, but other materials such as plastic are contemplated. The flexible cover 72 is connected to the portion 71 of the metallic frame 68 of the storage compartment 64 via straps (not shown) so as to be retained on the rigid top 46 when the flexible cover 72 is unfolded to cover the deck 14. It is contemplated that the flexible cover 72 could be connected to the rigid top 46 via other connections, such as by pressure fasteners or rivets for example. It is contemplated that the flexible cover 72 could be made of two sections. One section would be used to cover the portion of the deck 14 forward of the rigid top 46 and the other section would be used to cover the portion of the deck 14 rearward of the rigid top 46. It is contemplated that each of the section would be connected to the storage compartment 64 and would be stored therein. It is also contemplated that the flexible cover 72 could not be connected to the storage compartment 64, and could therefore be completely removable from the storage compartment 64. It is also contemplated that the rigid top 46 could not be provided with the storage compartment 64, in which case, the flexible cover 72 would have to be stored elsewhere when not in use.

Turning now to FIGS. 1 and 5 to 8, the installation of the flexible cover 72 onto the boat 10 will described.

Figure 2:
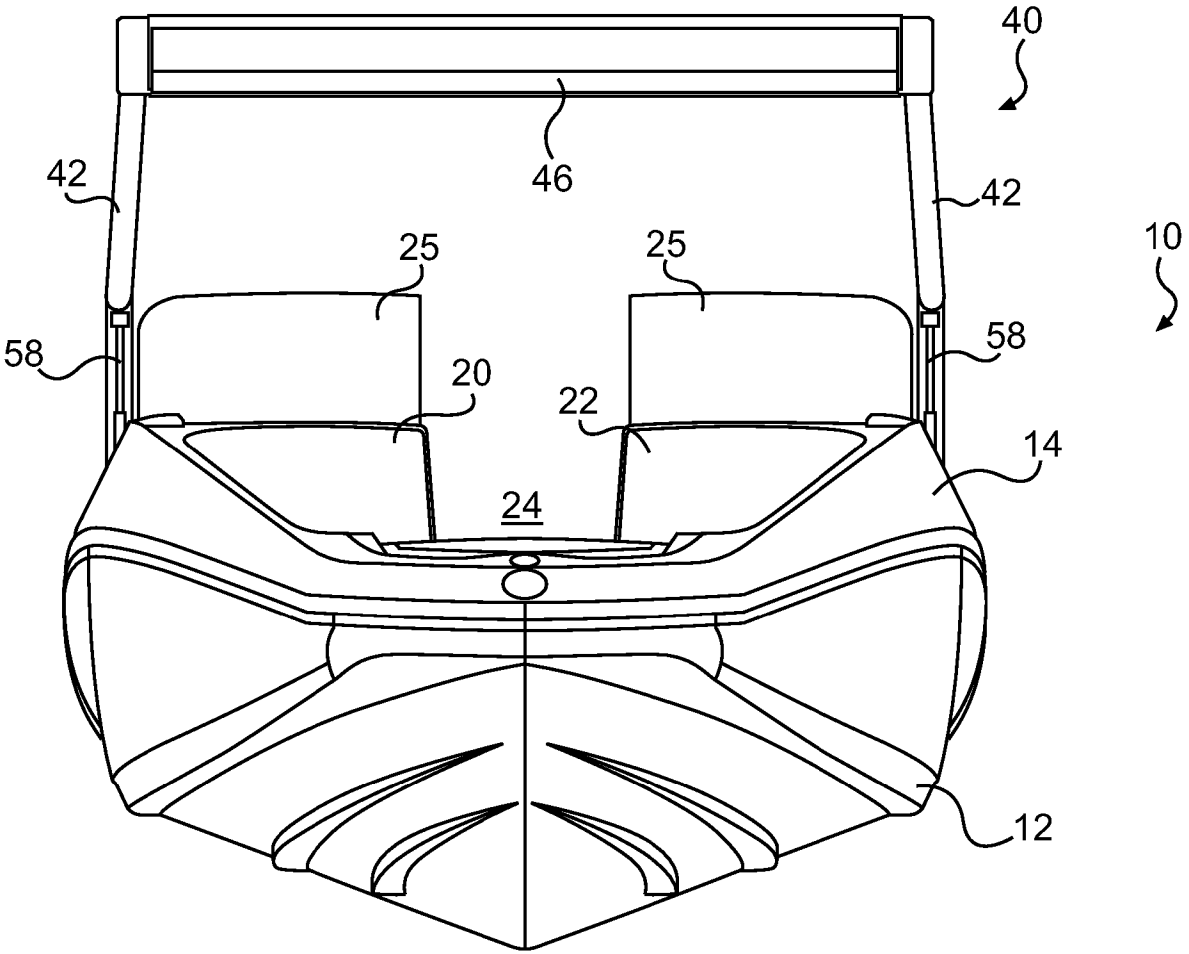
FIG. 2 is a front elevation view of the boat of FIG. 1.

When the boat 10 is in operation, the tower 40 is in a raised position as shown in FIG. 1. In this position of the tower 40, the rigid top 46 provides shade to the driver's area of the deck 14 and is preferably sufficiently high to allow a person to walk under the rigid top 46 without having to crouch. In order to install the flexible cover 72, the tower 40 first needs to be lowered to the position shown in FIGS. 5 and 6. To do this, a person uses the remote control 60 to send a signal to the linear actuators 58 to cause the linear actuators 58 to pivot the tower 40 to the position shown in FIGS. 5 and 6. In this position, the rigid top 46 is low enough for a person to be able to remove the lid 66 and access the flexible cover 72 inside the storage compartment 64.

Once unfolded, the periphery of the flexible cover 72 is connected to the deck 14 via known connecting methods. For example, the flexible cover 72 could be connected to the deck 14 using pressure fasteners (i.e. snaps), hooks and loops, a ratcheting mechanism, elastics, or a combination thereof. Other types of connections are contemplated. It is also contemplated that the flexible cover 72, or at least a portion thereof, could be connected to the hull 12 instead of the deck 14. The flexible cover 72 is first connected to one side of the deck 14 while the person installing the flexible cover is still on the deck 14. Then the cover 72 is extended over the deck 14 so as to cover the passenger areas 16, 18 and the tower 40, including the rigid top 46. The person installing the flexible cover 72, who is now standing outside the deck 14, on a dock for example, then finishes to fasten the flexible cover 72 to the other side of the deck 14. It should be understood that this is only an exemplary way of fastening the flexible cover 72 to the deck 14. It is contemplated that the flexible cover 72 could first be connected to one of the bow and transom of the boat 10 and then to the other of the bow and transom. It is also contemplated that a majority of the flexible cover 72 could be connected to the deck 14 while the person installing the flexible cover 72 is on the deck 14, leaving only a small region unconnected to allow the person to get off the deck 14 and to then connect this region. It is also contemplated that one or more apertures could be provided in the flexible cover 72. The apertures would allow the person installing the flexible cover 72 to stand through the apertures to facilitate the installation of the flexible cover. Once the installation of the flexible cover 72 completed, the apertures would be closed using one or more fasteners that would prevent rain water to pass through the apertures.

Figure 7:
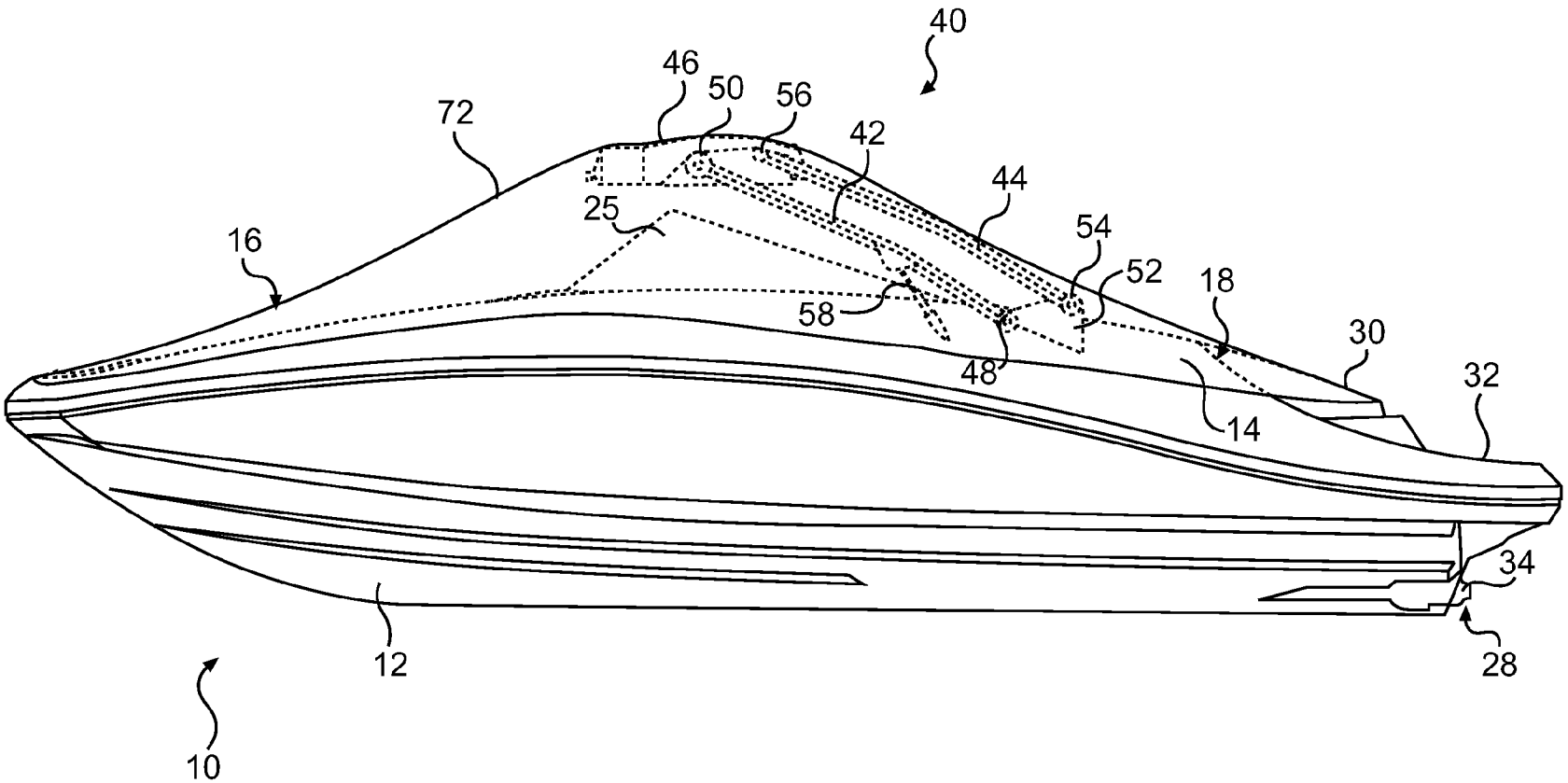
FIG. 7 is a left side elevation view of the boat of FIG. 1, with the tower in the lowered position and with a flexible cover covering the deck.
Figure 8:
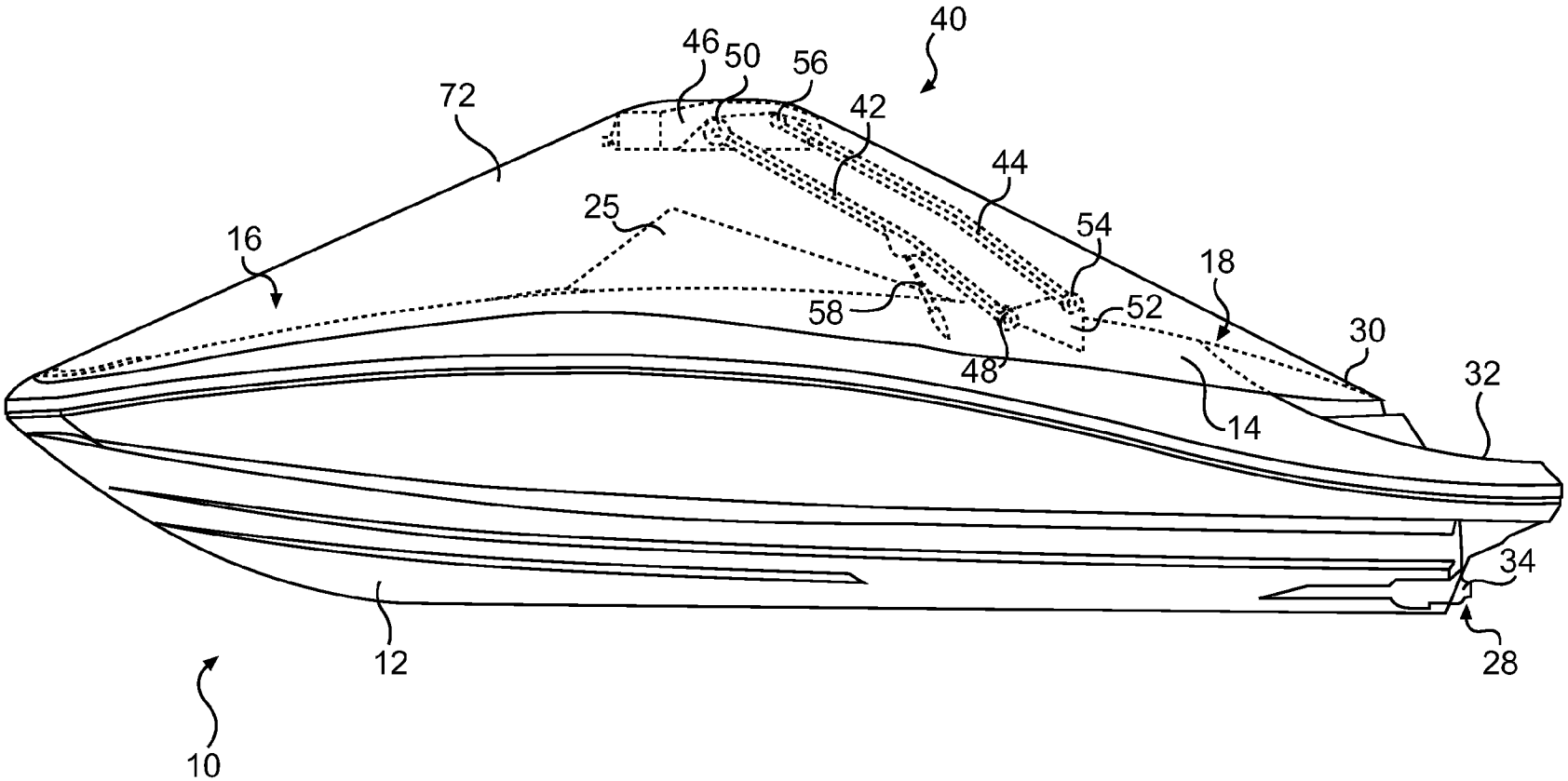
FIG. 8 is a left side elevation view of the boat of FIG. 1, with the tower in a cover tensioning position and with the flexible cover covering the deck.

FIG. 7 illustrates the boat 10 with the flexible cover 72 connected thereto. The portions of the boat 10 that are covered by the flexible cover 72 are shown in phantom. As can be seen, some areas of the flexible cover 72 sag slightly which would allow rain water to pool on the flexible cover 72. In order to prevent this from happening, a person uses the remote control 60 to send a signal to the linear actuators 58 to cause the linear actuators 58 to pivot the tower 40 to the position shown in FIG. 8. In this position of the tower 40, the rigid top 46 is slightly higher than in the lowered position shown in FIGS. 5 to 7. Since the flexible cover 72 covers the rigid top 46, moving the tower 40 to the position shown in FIG. 8 tensions the flexible cover 72 thus mostly eliminating areas where rain water could pool on the flexible cover 72. A support 74 (FIG. 4) mounted on the portion 71 of the of the metallic frame 68 of the storage compartment 64 supports the highest portion of the flexible cover 72 in order to further prevent rain water pooling in that area of the flexible cover. The position shown in FIG. 8 could be a preset position of the tower 40, or sensors could be used to determine when the flexible cover 72 is sufficiently tensioned.

It is contemplated that the flexible cover 72 could be connected to the bottom and/or the sides of the rigid top 46 instead of covering the rigid top 46 with the flexible cover 72. It is also contemplated that the flexible cover 72 may only cover a portion of the rigid top 46. It is also contemplated that a first flexible cover could be used to cover the forward passenger area 16 and a second flexible cover could be used to cover the rearward passenger area 18.

To remove the flexible cover 72 from the deck 14, the tower 40 is moved back to its lowered position (FIG. 7), the flexible cover 72 is then disconnected from the deck 14, and the flexible cover 72 is finally folded and stored inside the rigid top 46.

Figure 9:
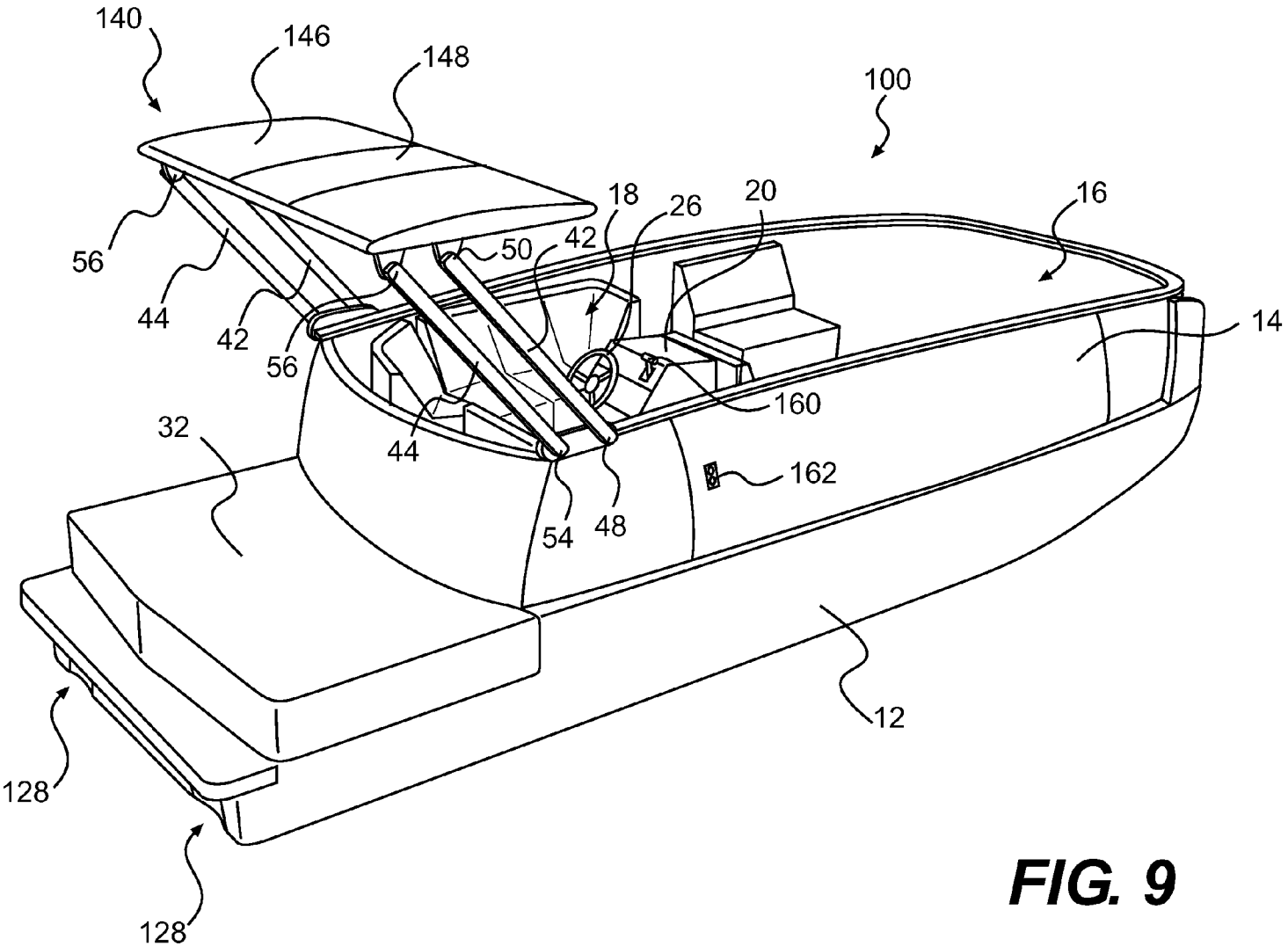
FIG. 9 is a perspective view, taken from a rear, right side, of an alternative embodiment of a boat according to the present invention, with a tower of the boat in a raised position.
Figure 10:
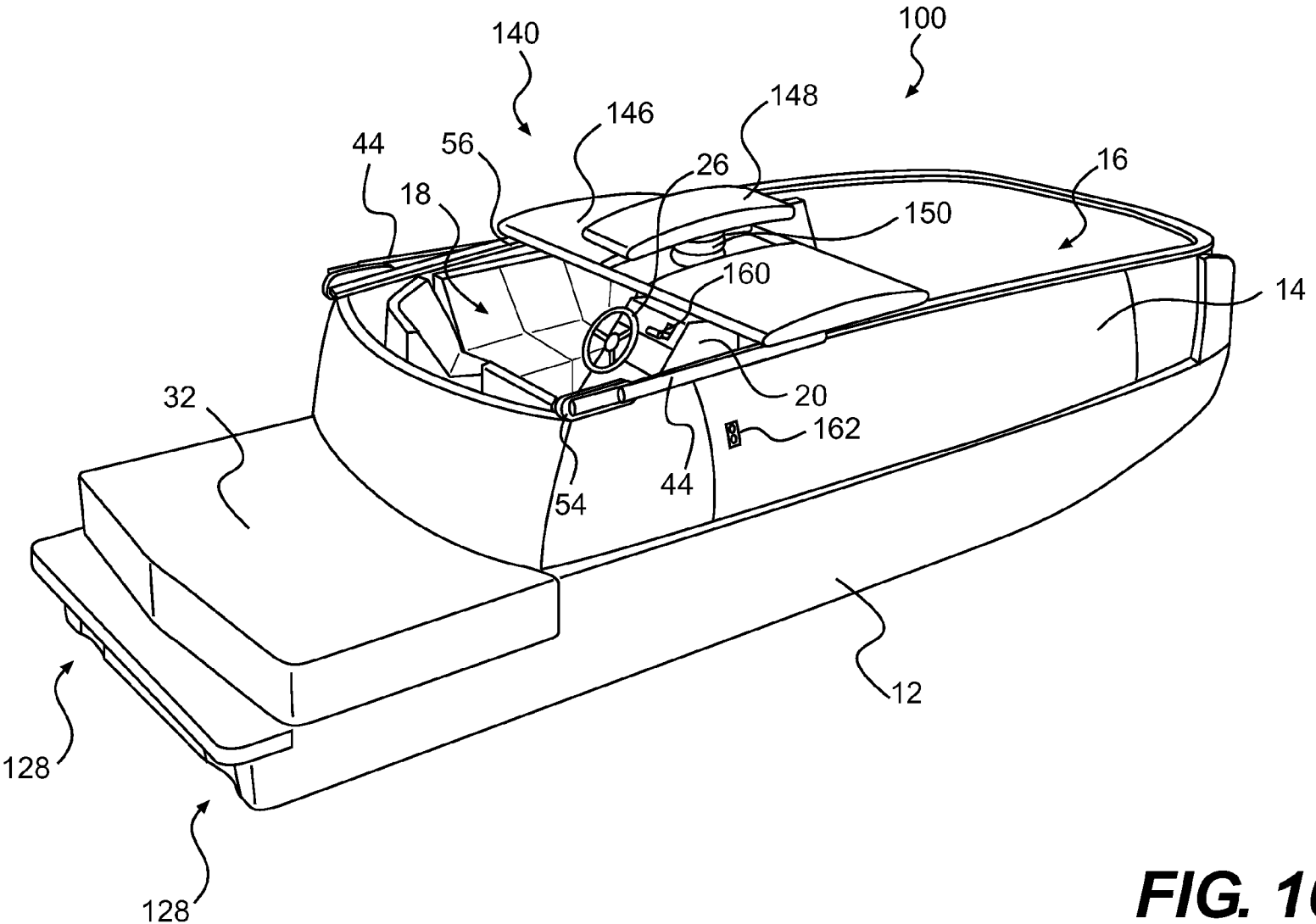
FIG. 10 is a perspective view, taken from a rear, right side, of the boat of FIG. 9, with the tower in a lowered position and a portion of the tower in a cover tensioning position.
Figure 11:
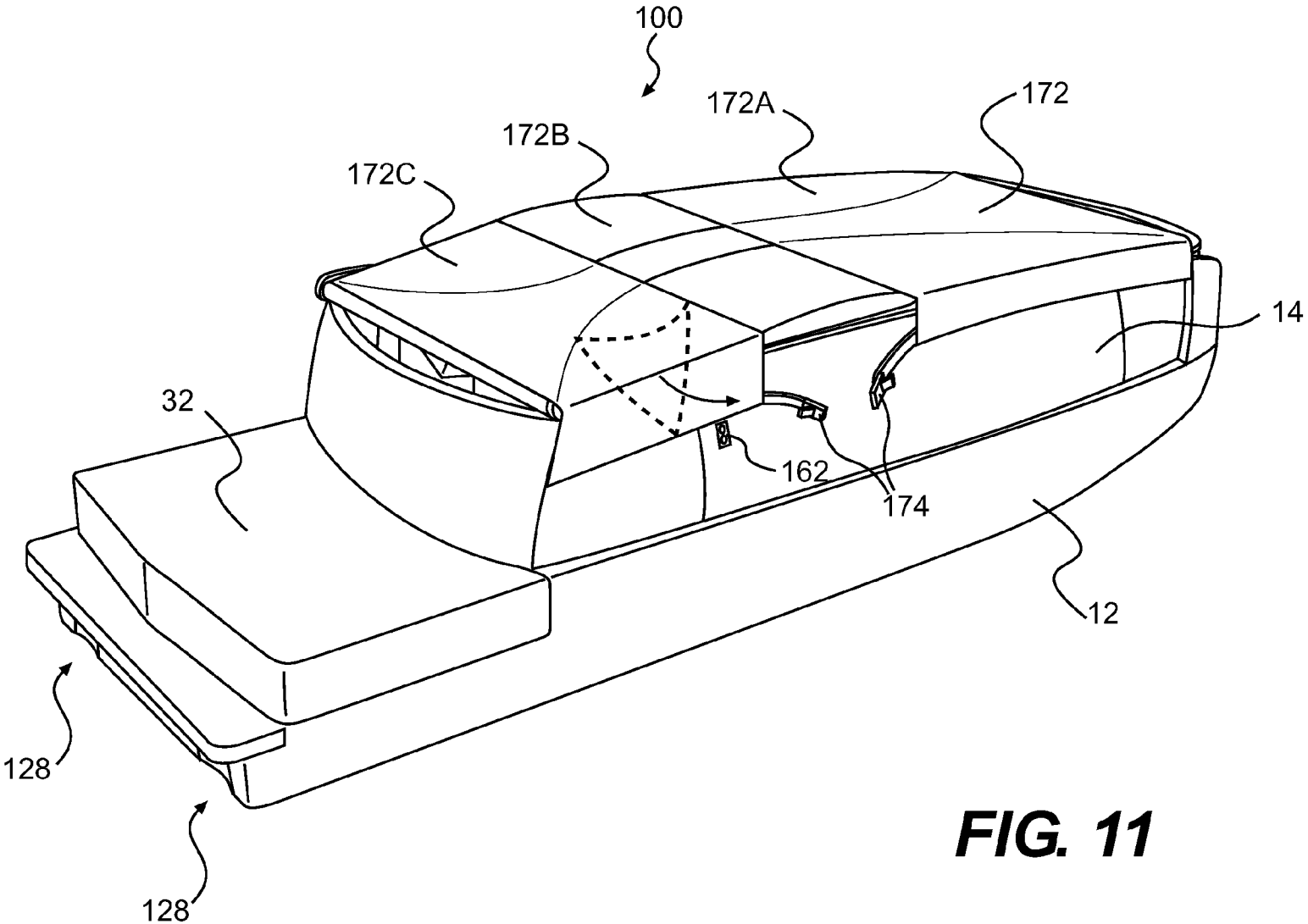
FIG. 11 is a perspective view, taken from a rear, right side, of the boat of FIG. 9, with the tower in the lowered position and with a flexible cover covering the deck.

Turning now to FIGS. 9 to 11, a second embodiment of a boat, the boat 100, will be described. For simplicity, features of the boat 100 which are similar to those of the boat 10 have been labeled with the same reference numeral and will not be described again in detail. The boat 100 is propelled by two stern drives 128. The boat 100 is provided with a tower 140 having a rigid top 146. The arms 42 and 44 can be pivoted used rotary actuators (not shown) located at the pivots 48, 54. However, it is contemplated that other actuators could be used, such as those described above with respect to the tower 40.

As can be seen in FIG. 10, the rigid top 146 has a central portion 148 that can be raised relative to the remainder of the rigid top 46 by an actuator 150. The actuator 150 could be any type of actuator that could be used to lift the central portion 148. For example, the actuator 150 could be a hydraulic cylinder or an electric motor coupled to a scissor mechanism. Since the rigid top 146 is used to house the actuator 150, the flexible cover (described below) is stored elsewhere, preferably in a storage compartment provided on the boat 100. However, it is contemplated that the flexible cover 172 could be stored in storage compartments formed in the rigid top 146 on both sides of the central portion 148.

One or more levers 160 are provided on the console 20. The lever 160 can be used by a user of the boat 10 to control the rotary actuators, and therefore the position of the tower 40, and/or the actuator 150, and therefore the position of the central portion 148. Switches 162 are provided on the outer side of the deck 14 which can be used by a user of the boat 10 to control the rotary actuators, and therefore the position of the tower 40, and/or the actuator 150, and therefore the position of the central portion 148, when the flexible cover 172 covers the deck 14. It is contemplated that a remote control, similar to the remote control 60 described above, could also be used to control the actuators.

A flexible cover 172, made of three sections 172A, 172B, 172C, is used to cover the deck 14 of the boat 100. To install the flexible cover 172, as described above with respect to boat 10, the tower 140 first needs to be lowered from the position shown in FIG. 9 to the position shown in FIG. 10. This is done using the lever 160 or the switches 162. The sections 172A, 172B, 172C are then connected to the deck 14 in a manner similar to that described above with respect to the flexible cover 72. As can be seen, the section 172A covers the front passenger area 16, the section 172B covers the rigid top 146, and the section 172C covers the rear passenger area 18. The sections 172A and 172C are also connected to the section 172B by slide fasteners (or other non-permanent fasteners), and the sections 172A and 172C are connected to each other by adjustable buckles 174. The slide fasteners are preferably covered by a portion of the section 172B so as to prevent water intrusion via the slide fasteners. It is contemplated that the flexible cover 172 could be made of a single section, two sections, or more than three sections.

Figure 12:
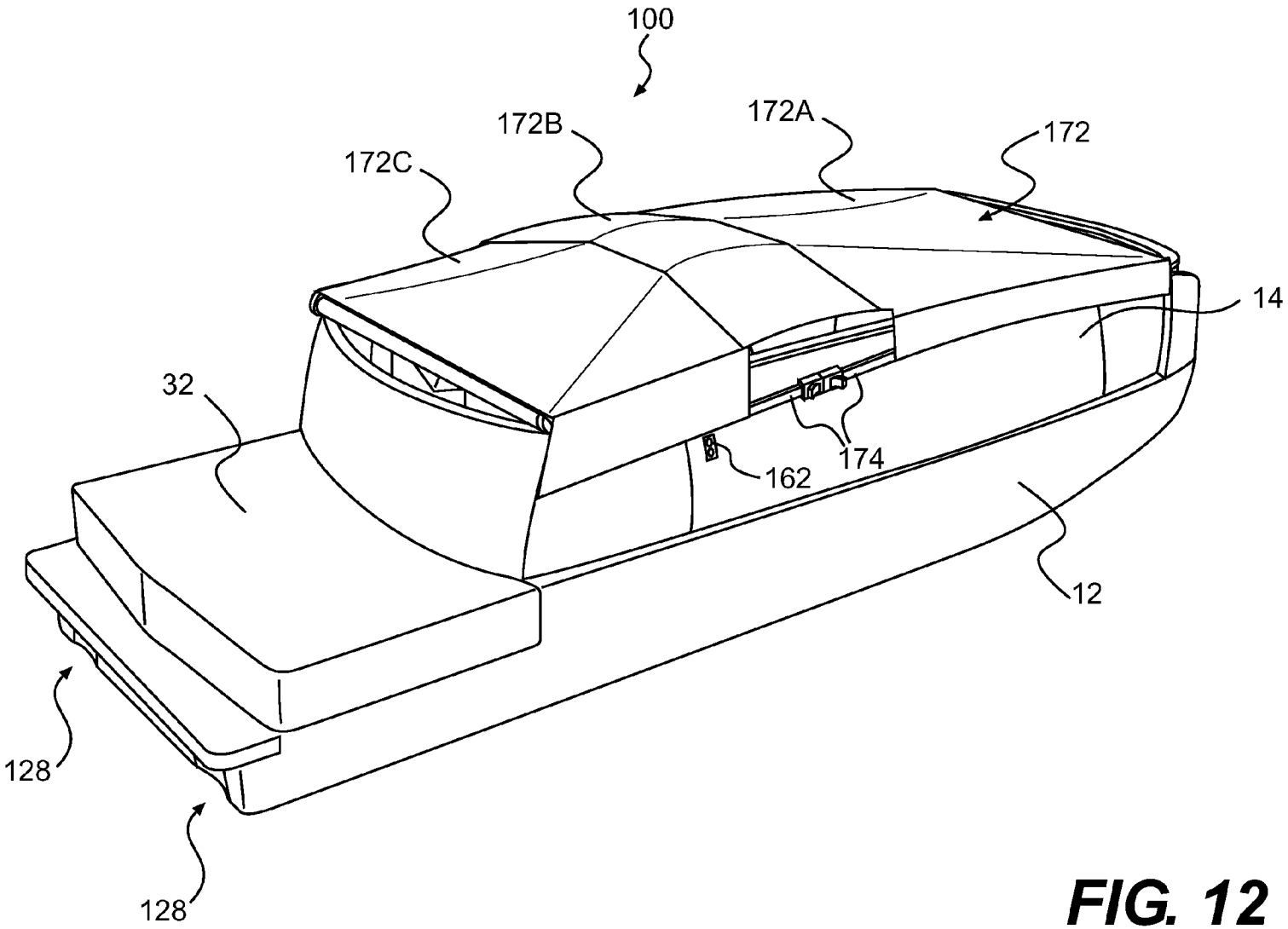
FIG. 12 is a perspective view, taken from a rear, right side, of the boat of FIG. 9, with the tower in the lowered position, the portion of the tower in the cover tensioning position and with a flexible cover covering the deck.

As can be seen in FIG. 11, some areas of the flexible cover 172 sag slightly, which could allow rain water to pool on the flexible cover 172. In order to prevent this from happening, a person uses the lever 160 or switches 162 to send a signal to the actuator 150 to cause the central portion 148 to be raised relative to the remainder of the rigid top 146. Since the flexible cover 172 covers the rigid top 46, and therefore the central portion 148, moving the portion 148 as described tensions the flexible cover 172 as shown in FIG. 12, thus mostly eliminating areas where rain water could pool on the flexible cover 172. The raised position of the central portion 148 could be a preset position or sensors could be used to determine when the flexible cover 172 is sufficiently tensioned.

It is contemplated that the cover 172 could be connected to the central portion 148 so as to move therewith instead of covering the central portion 148.

To remove the flexible cover 172 from the deck 14, the central portion 148 is lowered, the flexible cover sections 172A, 172B, 172C are then disconnected from the deck 14 and from each other, and the flexible cover sections 172A, 172B, 172C are finally folded and stored in their storage compartment.

Figure 13:
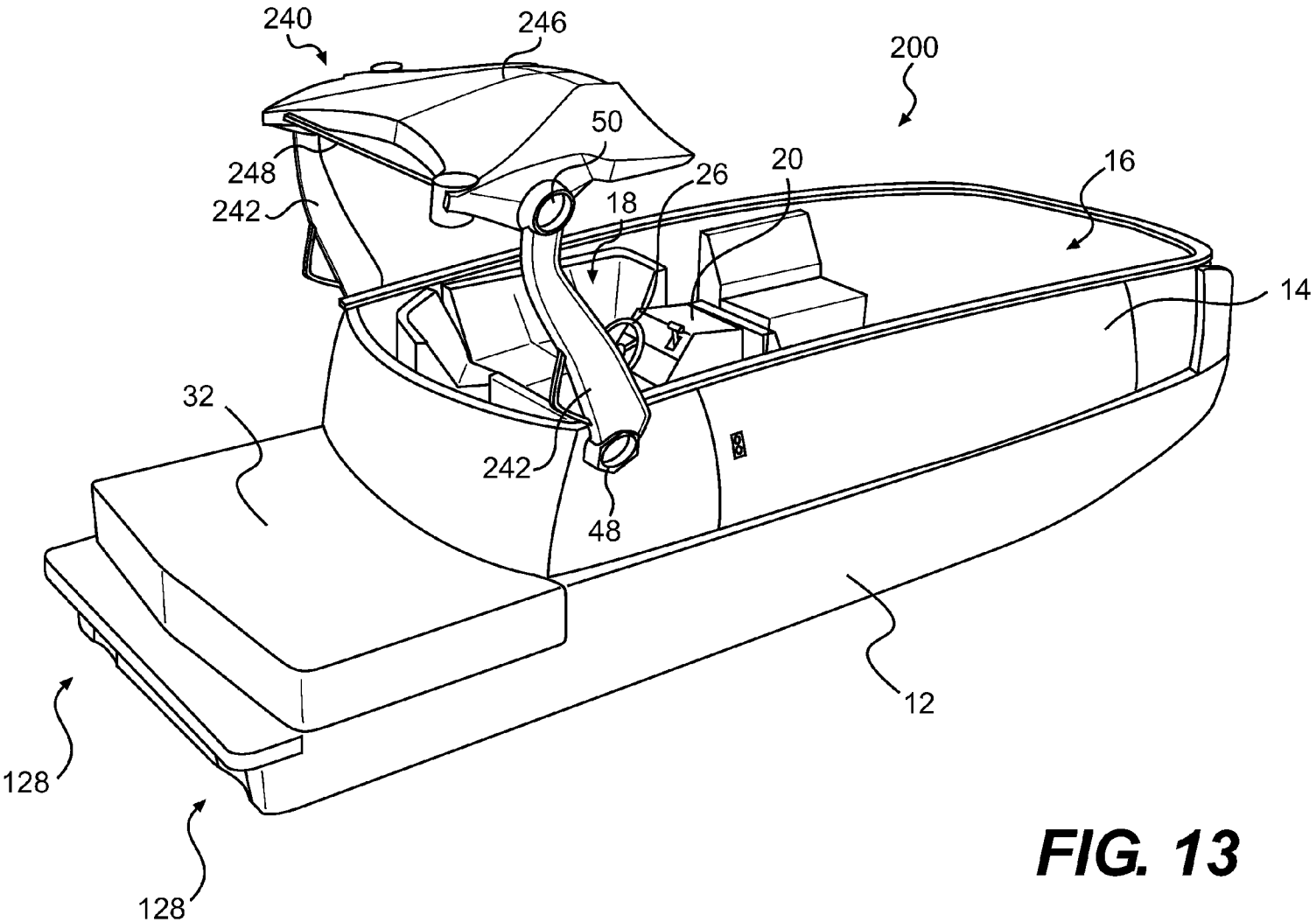
FIG. 13 is a perspective view, taken from a rear, right side, of another alternative embodiment of a boat according to the present invention, with a tower of the boat in a raised position.

Turning now to FIG. 13, a third embodiment of a boat, the boat 200, will be described. For simplicity, features of the boat 200 which are similar to those of the boat 100 have been labeled with the same reference numeral and will not be described again in detail. The boat 200 is provided with a tower 240 having a rigid top 246. The rigid top 246 is supported by a single left arm 242 and a single right arm 242 which can be pivoted using rotary actuators (not shown) located at the pivots 48. However, it is contemplated that other actuators could be used, such as those described above with respect to the tower 40. A remote control, similar to the remote control 60 described above, is used to control the actuators, and therefore pivot the tower 240. Alternatively, it is contemplated that levers and or switches could be used to control the actuators. The rigid top 246 is provided with a bar 248 at the rear thereof that can be used to tow a water skier or a wakeboarder, for example, behind the boat 200.

To install a flexible cover on the boat 200, the tower 240 is first lowered, the flexible cover is then connected to the deck 14 so as to cover the deck 14, and the tower 240 including the top 246. The tower 240 is then raised slightly so as to tension the flexible cover, similarly to what has been described above with respect to boat 10.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A boat coverable by a flexible cover, the boat comprising:

a hull;

a deck disposed on the hull;

a tower movably connected to the deck, the tower having a central structure, the tower being movable between a first position and a second position, the central structure being closer to the deck when the tower is in the second position than when the tower is in the first position, the deck being coverable by the flexible cover when the tower is in the second position such that the flexible cover is associated with at least a portion of the central structure, the portion of the central structure being movable to a third position vertically intermediate positions of the central structure in the first and second positions of the tower to tension the cover between the portion of the central structure and at least one of the deck and the hull.

2. The boat of claim 1, wherein the tower is movably connected to the deck via a pivot.

3. The boat of claim 1, wherein the complete central structure is movable to the third position to tension the cover.

4. The boat of claim 1, further comprising an actuator operatively connected to the tower to move the tower between the first and second positions.

5. The boat of claim 1, further comprising an actuator operatively connected to the portion of the central structure;

wherein the actuator is adapted to move the portion of the central structure to the third position while a remainder of the central structure remains in the position of the central structure in the second position of the tower.

6. The boat of claim 1, wherein the central structure is a rigid top.

7. The boat of claim 6, wherein the rigid top defines a storage compartment therein adapted to receive the flexible cover when the flexible cover is not covering the deck.

8. The boat of claim 6, further comprising at least one canopy connected to the rigid top.

9. The boat of claim 1, wherein the deck is coverable by the flexible cover when the tower is in the second position such that the flexible cover covers at least the portion of the central structure.

10. A boat comprising:

a hull;

a deck disposed on the hull;

a tower movably connected to the deck, the tower including:

a left arm having a first end movably connected to a left side of the deck;

a right arm having a first end movably connected to a right side of the deck; and a central structure movably connected to a second end of the left arm and a second end of the right arm, the central structure being at least partially disposed laterally between the left and right arms; and a flexible cover connected to the central structure;

the tower being movable between a first position and a second position, the central structure being closer to the deck when the tower is in the second position than when the tower is in the first position, the flexible cover being selectively connectable to at least one of the hull and the deck when the tower is in the second position such that the flexible cover covers at least a portion of the deck, the portion of the central structure being movable to a third position vertically intermediate the positions of the central structure in the first and second positions of the tower to tension the cover.

11. The boat of claim 10, wherein the first end of the left arm is movably connected to the left side of the deck via a pivot;

wherein the first end of the right arm is movably connected to the right side of the deck via a pivot; and wherein the central structure is movably connected to the second end of the left arm and the second end of the right arm via pivots.

12. The boat of claim 10, further comprising an actuator operatively connected to at least one of the left and right arms to move the tower between the first and second positions.

13. The boat of claim 10, wherein the complete central structure is movable to the third position to tension the cover.

14. The boat of claim 10, further comprising an actuator operatively connected to the portion of the central structure;

wherein the actuator is adapted to move the portion of the central structure to the third position while a remainder of the central structure remains in the position of the central structure in the second position of the tower.

15. The boat of claim 10, wherein the central structure is a rigid top;

wherein the rigid top defines a storage compartment therein adapted to receive the flexible cover when the flexible cover is not covering at least the portion of the deck; and wherein the flexible cover is connected to the storage compartment.

16. The boat of claim 10, wherein the left arm is a first left arm and the right arm is a first right arm;

the boat further comprising:

a second left arm having a first end movably connected to the left side of the deck rearwardly of the first left arm; and a second right arm having a first end movably connected to the right side of the deck rearwardly of the first right arm; and wherein the central structure is movably connected to a second end of the second left arm and a second end of the second right arm, the central structure being at least partially disposed laterally between the second left arm and the second right arm.

17. The boat of claim 10, wherein the flexible cover is selectively connectable to at least one of the hull and the deck when the tower is in the second position such that the flexible cover covers at least a portion of the central structure.

18. A method of installing a flexible cover on a boat, the boat having a hull, a deck disposed on the hull, and a tower movably connected to the deck, the tower having a central structure, the method comprising:

lowering the central structure;

covering at least a portion of the deck with the flexible cover once the central structure is lowered;

connecting the flexible cover to at least one of the deck and the hull; and raising at least a portion of the central structure associated with the flexible cover once the flexible cover is connected to tension the cover.

19. The method of claim 18, wherein lowering the central structure includes pivoting the tower.

20. The method of claim 18, wherein raising at least the portion of the central structure includes raising the complete central structure.

21. The method of claim 18, wherein the flexible cover includes multiple cover sections;

the method further comprising connecting the multiple cover sections to one another.

22. The method of claim 18, wherein the central structure is a top.

23. The method of claim 18, further comprising covering at least a portion of the central structure with the flexible cover once the central structure is lowered;

wherein the portion of the central structure associated with the flexible cover is the portion of the central structure covered with the flexible cover.

* * * * *